US005799791A

United States Patent [19]

Harley

[11] Patent Number: 5,799,791

[45] Date of Patent: Sep. 1, 1998

[54] PORTABLE SHOWCASE FOR COLLECTABLE ITEMS

[76] Inventor: Beth A. Harley, 106 Round Leaf Ct., Peachtree City, Ga. 30269

[21] Appl. No.: 872,087

[22] Filed: Jun. 10, 1997

[51] Int. Cl.[6] ..... A45C 13/00

[52] U.S. Cl. ..... 206/478; 190/16; 190/102; 206/757; 206/771; 206/776

[58] Field of Search ..... 190/16, 102, 109, 190/121, 903, 900; 206/736, 756, 757, 759, 769, 771, 776, 782, 477, 478, 481, 483, 747–749, 459.5

[56] References Cited

U.S. PATENT DOCUMENTS

| | | | |
|---|---|---|---|
| 929,074 | 7/1909 | Brown et al. | 190/16 |
| 974,874 | 11/1910 | Glossinger | 190/16 X |
| 1,867,886 | 7/1932 | Mayers . | |
| 2,038,319 | 4/1936 | Stanley | 190/16 X |
| 2,299,673 | 10/1942 | Zollard | 190/102 X |
| 2,319,497 | 5/1943 | Franklin . | |
| 2,707,538 | 5/1955 | Mayer, Sr. et al. | 190/16 |
| 2,744,621 | 5/1956 | Kegevic . | |
| 2,784,840 | 3/1957 | Stefanik | 190/16 X |
| 3,124,225 | 3/1964 | Rosenberg | 190/16 |
| 3,913,711 | 10/1975 | Schmid . | |
| 4,444,418 | 4/1984 | Goldstein . | |
| 4,746,009 | 5/1988 | Liberman . | |

*Primary Examiner*—Bryon P. Gehman

[57] ABSTRACT

Invention relates to a portable and display carrying case for receiving, displaying an transporting a plurality of collectable items, such as the popular Beanie Babies, and related accessories. The case comprises a pair of outer members, preferably rectangular in shape, hingedly secured along one pair of complementary edges, and a center inner panel member configured to nest between the outer members. The inner panel member is provided with an array of elastic-type straps secured at their respective ends to the inner panel member, to receive the items, and includes a corresponding array of collapsible boxes for securing the accessories. Fastening members are provided to secure the outer members together, such as a zipper, about the periphery thereof to form a closed carrying case. Finally, a handle may be included along the periphery of the case for easily transporting the Beanie Babies.

16 Claims, 3 Drawing Sheets

PORTABLE SHOWCASE FOR COLLECTABLE ITEMS

FIELD OF INVENTION

This invention is directed to a portable and display carrying case, particularly for use by children, to receive, display and/or transport a plurality of collectable items, such as dolls and related accessories. Collectable items, the Barbie Dolls being especially well known items, are desirable by children as subjects of playing and sharing with friends. A recent craze among children is the Beanie Baby, a colorful, animal shaped cousin of the bean bag of years past. As the popularity of Beanie Babies grows dramatically, and to sustain such popularity, the need arose for a convenient and light weight means to display and transport children's collectable items, such as the Beanie Babies. This invention is intended to satisfy such need in unique manner.

BACKGROUND OF THE INVENTION

The prior art is replete with references to various types of portable carrying cases, none of which, however, are uniquely designed nor intended for children.

U.S. Pat. No. 4,746,009, to Liberman, relates to a carrying case for a display board that carries information and product samples. The case includes at least one pair of opposed, interior-facing slots for receiving a display board, and an open aperature to expose one face of the display board. Typically, the display board includes electrical components which may be removed from the carrying case and connects to a processor, such as a microprocessor or a computer, for operating the electrical components in an integrated manner for display.

U.S. Pat. No. 4,444,418, to Goldstein, is directed to a carrying case for information and product samples. This case is particularly adapted for artwork or other similar, substantially flat material.

U.S. Pat. No. 3,913,711, to Schmid, relates to a portable display case comprising a pair of containers detachably connected to each other. Each container has a hingably connected cover portion that may be laid flat to support the compartment in a vertical position allowing display of goods contained therein.

U.S. Pat. No. 2,744,641, to Kegevic, discloses a tool kit comprising an openable, zippered case having removably attached panels, each having pockets, loops or other holding elements.

Finally, the patents to Franklin and Mayers, U.S. Pat. Nos. 2,319,497 and 1,867,886, respectively, each relate to display types cases for shoes. None of these prior art patents relate to a carrying case that is suitable for children and adaptable to display and transport collectable items, such as dolls. The present invention meets these special objectives by a unique design and assembly. The manner by which such objectives are achieved will become apparent to those skilled in the art upon reading the following specification, particularly when read in conjunction with the accompanying drawings.

SUMMARY OF THE INVENTION

This invention is directed to a children friendly carrying case for displaying and transporting collectable items, such as dolls or small stuffed animals, and related accessories. The carrying case is light weight and easy to use for children desiring to play and share their prized collectable items with friends. The carrying case comprises a pair of outer members, preferably rectangular in configuration and having a portal or transparent panel for visual inspection, hingedly secured along one pair of complementary edges thereof, and a center inner panel member disposed between the outer members. The inner panel member is provided with an array of elastic-like elongated straps secured at their respective ends to the inner panel member, and a corresponding array of collapsible boxes having a releasably engaging cover for securing accessories therein. Means are also provided for securing the outer members together about the periphery thereof to form a closed carrying case, where such means may be a zipper or VELCRO hook and loop fasteners, as known in the art. Further, handle means are incorporated along the periphery of the case for easily transporting the contents thereof. An optional feature thereof may include indicia associated with each strap and its complementary collapsible box to identify the specific item to be nestled under the strap.

DETAILED DESCRIPTION OF PREFERRED EMBODIMENTS

This invention relates to a portable and display carrying case, designed especially for children to help them display and/or transport collectable items, such as dolls and stuffed animals, and related accessories.

Figure 1:
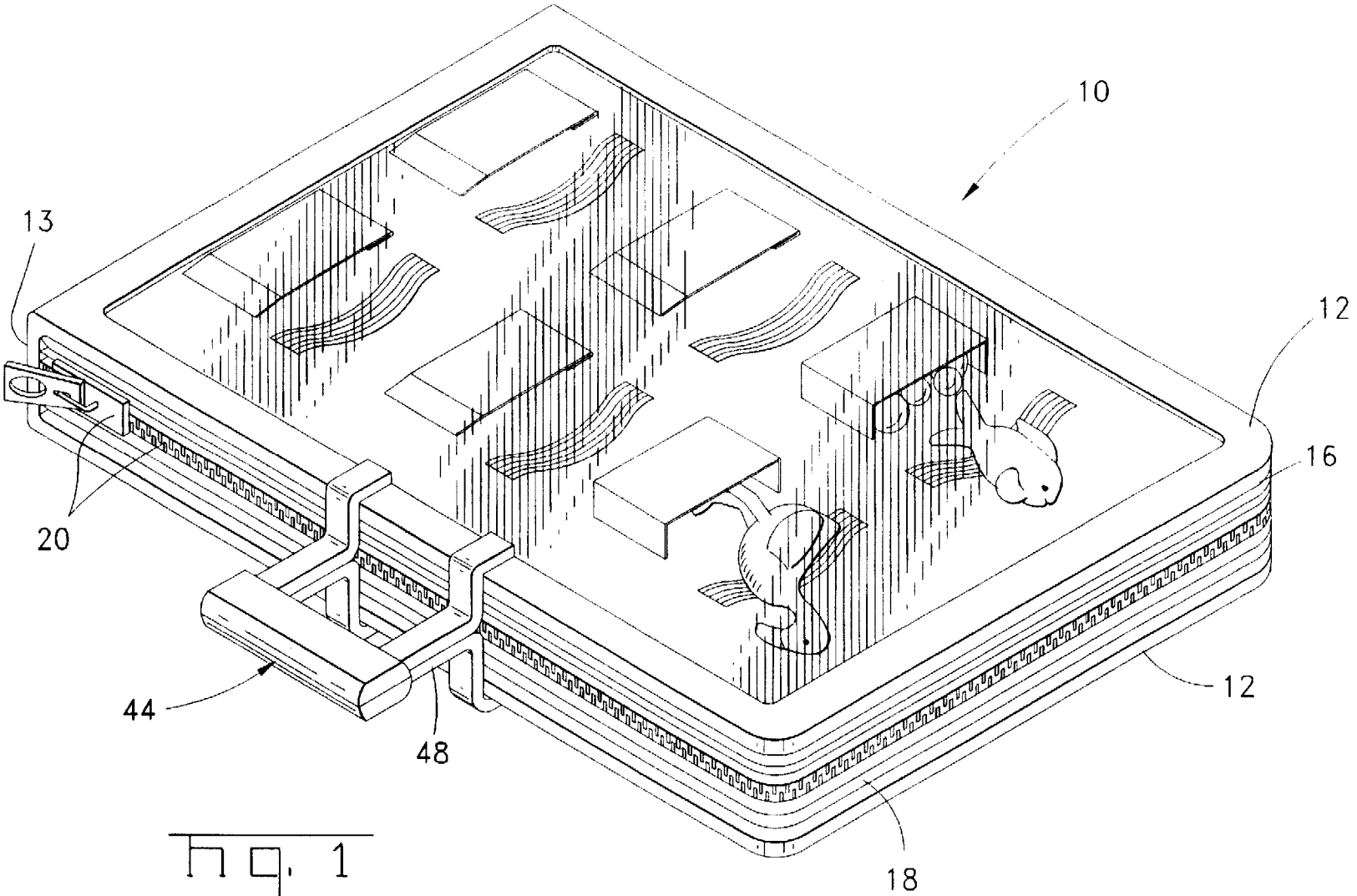
FIG. 1 is a perspective view of a closed carrying case according to this invention, illustrating details to nest and contain various collectable items and related accessories.
Figure 2:
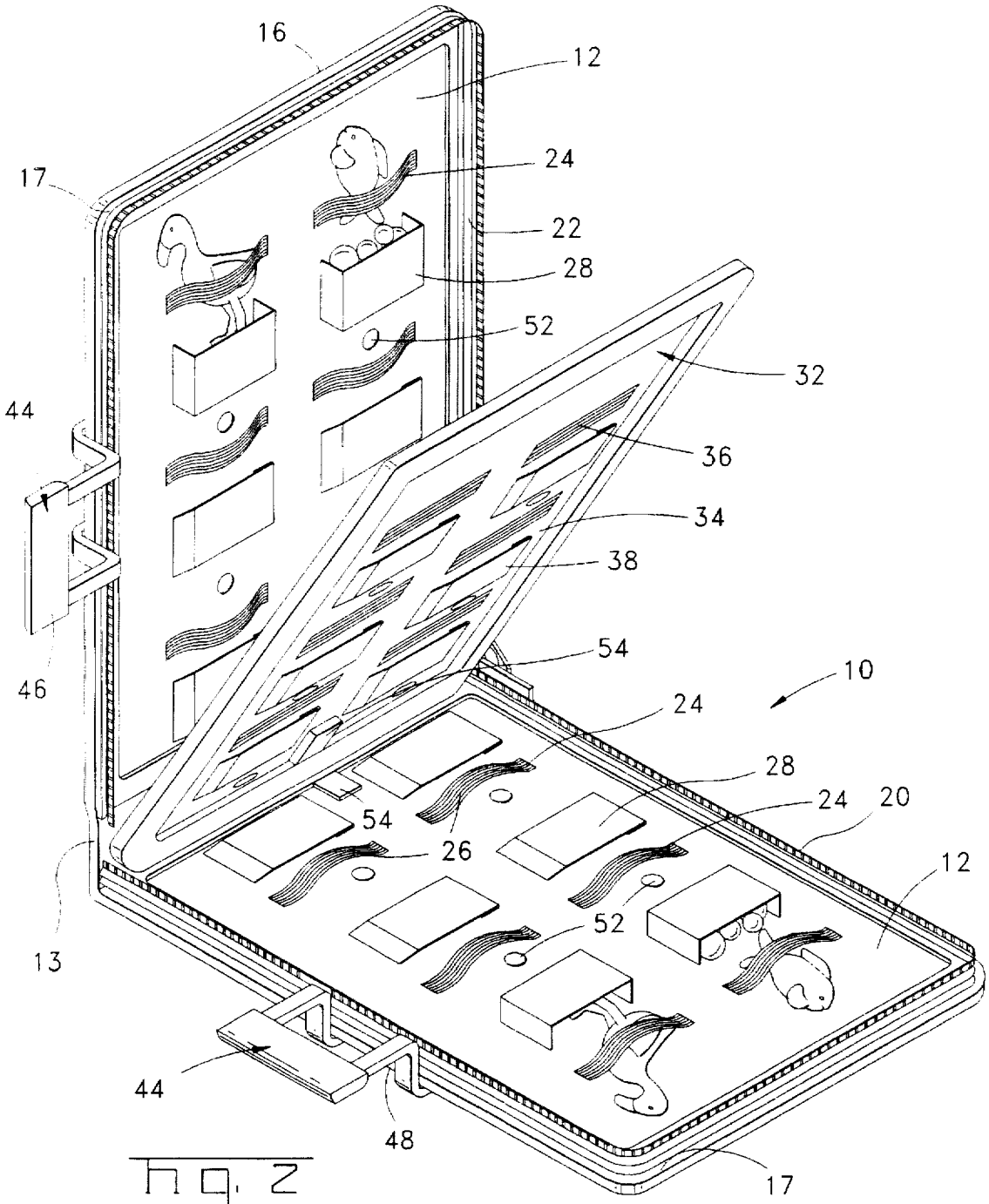
FIG. 2 is a perspective view of the opened carrying case of FIG. 1.

FIGS. 1 and 2 illustrate a first preferred embodiment of this invention for a carrying case 10, where such invention comprises a pair of outer members 12, essentially identical in construction, hinged along a common side 14. The outer members 12, preferably rectangular in shape, though an essentially circular configuration may be suitable, may be formed of clear plastic to allow convenient visual inspection of the contents of the carrying case 10. The annular edge 16 of each outer member 12 is curved terminating in a flat continuous shoulder 17 such that when mated with the companion outer member a three-dimensional enclosure is formed. For design and aesthetic purposes, the curved portion may be opaque to allow for name or logo identification, while the planar portion is transparent for easy display.

The hinged or spine portion 13, formed of a flexible fabric material, such as canvas, allows for easy closing of the carrying case 10 when filled with the desirable collectable items and accessories. Likewise, the remaining peripheral portion of each outer member may be provided with a canvas-like skirt 18 having some fastening means, such as a zipper 20, see FIG. 1, along the free edge 22. By this arrangement, a complete enclosure may be effected by simply zippering around such remaining periphery.

In a preferred embodiment, the interior or concave surface of the outer member 12 may be provided with an array of elastic-like straps 24, secured at their respective ends 26, such as by an adhesive, to such surface. Such strap 24, by its elastic nature, provides a comfortable and easy nesting place for the collectable item inserted thereunder. Additionally, a complementary array of collapsible boxes 28, formed of a fabric or canvas-like material, preferably with a flapped cover, is provided to accommodate accessories to a given collectable item. Since VELCRO hook and loop fasteners are now quite common for even the youngest of children, a VELCRO hook and loop tab may be used to secure the cover to its collapsible box.

A planar inner panel 32, which may be commonly hinged to the inner side of hinged portion 13, or free standing, may be positioned between the respective outer members 12, as best seen in FIG. 2. This planar inner panel 32 may be formed of a single sheet of cardboard, or a pair of sheets laminated for added strength. Each planar side 34 of the inner panel 32 is provided with an array of elastic-like straps 36 and accompanying collapsible boxes 38, in the manner described above. By this arrangement, the capacity of the carrying case 10 to hold various collectable items has been doubled.

Figure 3:
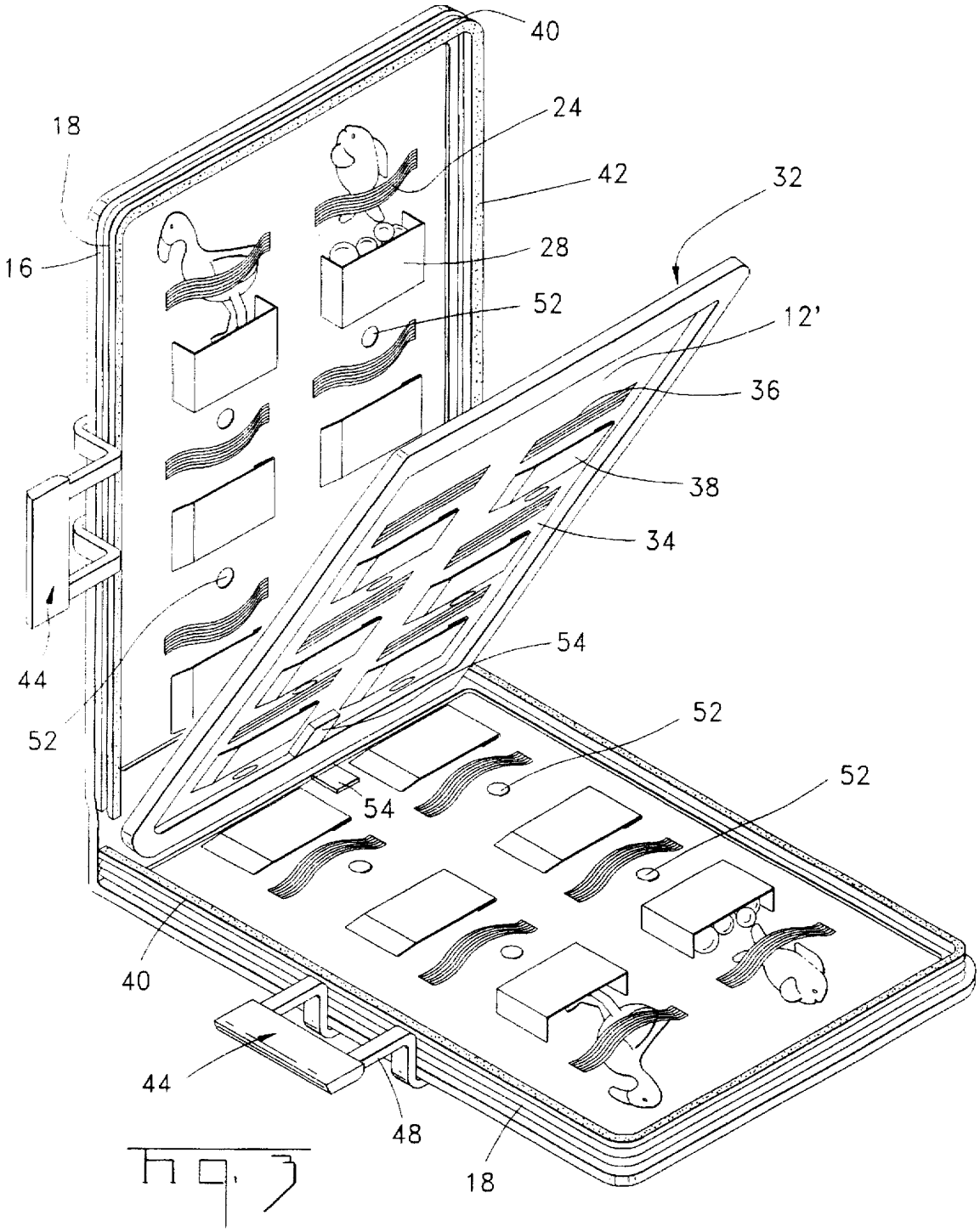
FIG. 3 is an perspective view, similar to FIG. 2, illustrating a second embodiment for securing the carrying case in a closed condition for ease of transporting.

Since VELCRO hook and loop fasteners have acquired a broad acceptance throughout the population as a simple and convenient manner to secure two surfaces together, FIG. 3 illustrates an alternative embodiment to the zipper arrangement illustrated in FIG. 1. To provide mating surfaces for the VELCRO hook and loop fastening strips, a flat plastic or similar ring 40 is provided for each outer member 12. The respective mating surfaces 42 of the ring 40 receive the complementary VELCRO hook and loop strips, i.e. one male and the other female, while the respective opposite surfaces are secured to the canvas-like skirt 18 extending from the annular edge 16 of the outer members 12. By simply closing the carrying case 10, engagement of the VELCRO hook and loop strips is achieved.

To facilitate the transport of the carrying case 10, one or two complementary handles 44 may be provided along the periphery of the outer members, see FIG. 1. The handle may consists of a gripping bar 46 suspended from a pair of straps 48 secured to one or both outer members, as the case may be, by appropriate fastening devices, not shown.

To use the carrying case, a child would inset their collectable items, such as an assortment of Beanie Babies, one at a time into the carrying case by placing them inside each elastic strap, thus containing the doll between the elastic strap and the case or inner panel itself, see FIG. 1. The child would then place any accessories for the dolls into the associated collapsible boxes. When the child wishes to display their dolls, he or she would unzip or otherwise open the case. The child would add to his or her collection as needed. When the child is finished displaying the dolls, he or she would simply place the dolls under their respective elastic straps, close the case, carry or store until the next time.

ALTERNATE FEATURES

In a desire to personalize the carrying case 10 to an individual child, it is contemplated that appropriate indicia 52 for a given collectable item, and accessories, may be provided adjacent a strap 24, 36 and complementary box 28, 38. This can take the form of a single label upon which may be handwritten the name of a doll or stuffed animal, for example, or a more sophisticated system. It is envisioned that the latter may be a manually activated, battery 54 operated, voice chip 52, as known in the art, which can announce a message, such as the name and an appropriate poem or text, for example to designate the collectible item. If desirable, the circuitry to the various strap and box locations, may be placed along the surface of the inner panel 34 or concave surface of the outer members 12', or between laminated sheets of the inner panel 32, where damage to the circuitry may be a concern.

As an alternative to providing specific sites for the collectable items along the concave surface of the outer members 12, a planar insert, similar to the inner panel 32, may be provided. That is, such insert, having site locations for the collectable items and boxes on only one side, may be snap or press fitted against the concave surface of the outer member. By simply incorporating plural nipples, during the manufacturing process, along the inner surface of the curved portion of the annular edge 16, sufficient retention will be achieved for the insert.

I claim:

1. A portable and display carrying case for receiving, displaying and transporting a plurality of collectable items, and related accessories, said case comprising (a) a pair of generally rectangular outer members hingedly secured along one pair of complementary edges thereof, and a center inner panel member configured to nest between said rectangular outer members, where said inner panel member is provided with an array of elastic straps secured at their respective ends to said inner panel member, and a corresponding array of collapsible boxes having a releasable engaging cover for securing the accessories therein, (b) means for securing said rectangular outer members together about the periphery thereof to form a closed carrying case, and (c) handle means along said periphery of the case for easily transporting the contents thereof.

2. The portable and display carrying case according to claim 1, wherein the inner surfaces of the respective rectangular outer members include like arrays of elastic elongated straps and collapsible boxes to provide four display surfaces for said collectable items and related accessories.

3. The portable and display carrying case according to claim 2, wherein at least a portion of said rectangular outer members comprises a transparent panel to allow visual inspection and display of the contents of the closed case.

4. The portable and display carrying case according to claim 1, wherein said means for securing said rectangular outer member together includes a movable zipper member and complementary zipper engaging teeth along said periphery.

5. The portable and display carrying case according to claim 1, wherein said means for securing said rectangular outer members together comprises a VELCRO hook and loop fastener system arranged about said periphery, said system including a pair of horizontally disposed, complementary sized, rectangular rings, where opposing surfaces contain respective male or female VELCRO hook and loop fastening means, and the respective opposing surfaces of said rectangular rings are secured to one of said rectangular outer members.

6. The portable and display carrying case according to claim 1, wherein said center inner panel member is hingedly disposed between said rectangular outer members.

7. The portable and display carrying case according to claim 1, wherein each said strap and corresponding collapsible box identifies a specific location for a single said collectable item, and that each said location includes distinctive indicia means for predetermining a position for a said collectable item.

8. The portable and display carrying case according to claim 7, wherein said indicia means includes a personalized label assigned to a given said collectable item.

9. The portable and display carrying case according to claim 7, wherein said indicia means includes a battery operated voice chip, the manual activation of which will announce a personalized message identifying each collectable item and related accessory.

10. The portable and display carrying case for receiving, displaying and transporting a plurality of collectable items, and related accessories, said case comprising (a) a pair of outer members hingedly secured along one pair of complementary edges thereof, and a center inner panel member configured to nest between said outer members, where said inner member is provided with an array of elastic-type straps secured at their respective ends to said inner panel member, and a corresponding array of collapsible boxes for securing said accessories therein, (b) means for securing said outer members together about the periphery thereof to form a closed carrying case, and (c) handle means along said periphery of the case for easily transporting the contents thereof.

11. The portable and display carrying case according to claim 10, wherein the inner surfaces of the respective outer members include like arrays of elastic-like elongated straps and collapsible boxes to provide four display surfaces for collectable items and related accessories.

12. The portable and display carrying case according to claim 11, wherein at least a portion of said outer members comprises a transparent panel to allow visual inspection and display of the contents of the closed case.

13. The portable and display carrying case according to claim 10, wherein said center inner panel member is hingedly disposed between said outer members.

14. The portable and display carrying case according to claim 10, wherein each said strap and corresponding collapsible box identifies a specific location for a single said collectable item, and that each said location includes distinctive indicia means for predetermining a position for a collectable item.

15. The portable and display carrying case according to claim 14, wherein said indicia means includes a personalized label assigned to a given collectable item.

16. The portable and display carrying case according to claim 14, wherein said indicia means includes a battery operated voice chip, the manual activation of which will announce a personalized message identifying each collectable item and related accessory.

* * * * *